US009668574B2

(12) United States Patent
Wagner et al.

(10) Patent No.: US 9,668,574 B2
(45) Date of Patent: Jun. 6, 2017

(54) FIXTURES FOR RETAINING OR STORING OBJECTS

(71) Applicants: Peter Joseph Wagner, Merritt Island, FL (US); Richard Thomas Ring, Orlando, FL (US)

(72) Inventors: Peter Joseph Wagner, Merritt Island, FL (US); Richard Thomas Ring, Orlando, FL (US)

( * ) Notice: Subject to any disclaimer, the term of this patent is extended or adjusted under 35 U.S.C. 154(b) by 0 days.

(21) Appl. No.: 14/756,068

(22) Filed: Jul. 28, 2015

(65) Prior Publication Data

US 2016/0045023 A1 Feb. 18, 2016

Related U.S. Application Data

(60) Provisional application No. 62/070,043, filed on Aug. 13, 2014.

(51) Int. Cl.
*A47F 5/00* (2006.01)
*A47B 81/00* (2006.01)

(52) U.S. Cl.
CPC ..... *A47B 81/005* (2013.01)

(58) Field of Classification Search
CPC ..... A47B 81/005; B63B 3/00; B63B 2739/00
See application file for complete search history.

(56) References Cited

U.S. PATENT DOCUMENTS 3,291,427 A * 12/1966 Hutchings ..... A47B 81/005 211/70.8
5,588,542 A * 12/1996 Winkler, Jr. ..... A47B 81/005 211/70.8
6,276,539 B1 * 8/2001 Richbourg ..... A47B 81/005 160/327
D486,779 S * 2/2004 Alberti ..... D12/406
7,219,464 B1 * 5/2007 Kujawa ..... A01K 97/08 211/70.8
D643,500 S * 8/2011 Sanders ..... D22/199
D736,076 S * 8/2015 Chang ..... A47B 81/005 D8/396

* cited by examiner

*Primary Examiner* — Amy Sterling
(74) *Attorney, Agent, or Firm* — Toan P. Vo

(57) ABSTRACT

A fixture adapted for attachment to a movable surface, for retaining or storing elongated objects, includes a set of two fixture members. Each fixture member has (a) at least a leg portion for attaching to the movable surface; and (b) a body portion adapted to include one or more openings extending therethrough. At least one opening is adapted for receiving one end of an elongated object. The surface is movable from a first position that is within reach of a user to a second position that is out of reach of, but is accessible by, the user such that the fixture allows for utilization of limited space.

12 Claims, 22 Drawing Sheets

ISOMETRIC VIEW

SIDE VIEW

ISOMETRIC VIEW

FRONT VIEW

SIDE VIEW

ISOMETRIC VIEW

FIXTURES FOR RETAINING OR STORING OBJECTS

This application claims the benefit of Provisional Patent Application No. 62/070,043 filed Aug. 13, 2014 which is incorporated by reference herein in its entirety.

BACKGROUND

In general, this invention relates to fixtures that are adapted to be attachable to surfaces for retaining or storing objects. In particular, this invention relates to fixtures that are attachable to surfaces to make use of otherwise unusable space for retaining or storing, and protecting objects. More particularly, this invention relates to fixtures that are attachable to movable surfaces for retaining or storing, and protecting objects.

Dwellings often have limited spaces for storage. For example, objects are often stored in garages, on the floor and ceilings or against the walls, and take up valuable spaces. Objects stored in such a way are difficult to locate and are often damaged. In addition, the space becomes cluttered. Therefore, there is a need to provide means that make maximal use of limited space. The present invention provides means, and creates additional capabilities from otherwise unusable space, for retaining or storing, and protecting equipment from damage in an innovative way. The present invention also provides means for easily locating and accessing stored objects in limited space. For example, such equipment may be fishing rods, garden tools, skis, or other elongated equipment that are delicate and easily damaged.

SUMMARY

In general, this invention relates to retaining or storage fixtures that are adapted to be attachable to surfaces for retaining or storing objects.

In particular, this invention relates to fixtures that are adapted to be attachable to surfaces to make use of otherwise unusable space for storing and protecting objects.

More particularly, this invention relates to fixtures that are adapted to be attachable to movable surfaces for retaining or storing objects.

In one aspect, a surface to which the fixtures are attached is movable from a first position that is within reach of a user to a second position that is out of reach of, but is easily accessible by, the user.

In one embodiment, the present invention provides a fixture adapted for attachment to a movable surface, the fixture comprising a set of two fixture members, each member comprising: (a) at least a leg portion for attaching to the movable surface; and (b) a body portion that, includes at least an opening therethrough, adapted for receiving one end of an elongated object; wherein the surface is movable from a first position that is within reach of a user to a second position that is out of reach of, but is accessible by, the user.

In another aspect, such a surface is a movable garage door surface. The fixtures create useful storage capabilities for the movable garage door.

In still another aspect, the present invention creates useful storage capabilities for garage doors for retaining or storing delicate equipment.

In one embodiment, such equipment may be fishing rods, garden tools, skis, or other delicate equipment.

Other features and advantages of the present invention will become apparent from the following detailed description and claims.

DETAILED DESCRIPTION

Figure 1A:
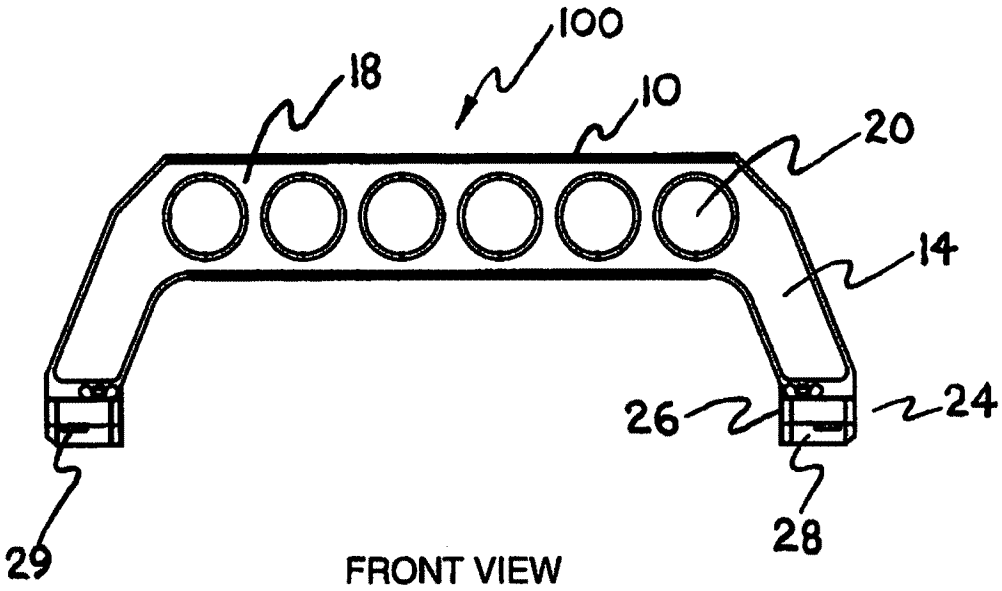
FIGS. 1A, 1B, and 1C show respectively the front view, side view, and isometric view of the first embodiment of a fixture of the present invention.

The innovative fixtures having retaining and/or storage capabilities are designed for utilizing the movable garage door as its point of attachment, an area that has never been utilized for any purpose of storage. A fixture assembly of the present invention, having retaining and/or storage capabilities, is also referred to herein as a hanger bracket assembly.

In one embodiment, the attaching method utilizes a clamp, in a method that easily attaches the clamp to features on the garage door panels without tools and holds elongated items, such as fishing rods, garden tools, skis, or like items in place during the full cycling of the garage door. Although a retaining or storage fixture in one embodiment of the present invention clamps to the edges of the garage door panels, it is built such that in another embodiment, a self-tapping screw to metal garage doors or wood screws to wooden garage door panels can also be used with or without the clamping portion of the holder.

In one embodiment, the present invention comprises fixtures for retaining and/or storage of elongated equipment, such as fishing rods, garden tools, skis, or like items, in a unique way, the fixtures being adapted for attachment on or to a movable surface, such as the panels of a garage door. The fixtures are designed to not interfere with normal movement of the surface to which they are attached. The design will not obstruct with the garage door panel wind brace supports that are inherent in wind fortified garage doors. The attaching mechanism securely attaches directly to the panel with no tools or can be additionally installed with or without self-tapping metal screws for metal surfaces or wood screws for wooden surfaces, such as metal or wooden garage doors. The invention can be utilized on each garage door panel and can be placed at any dimension from each other as deemed necessary by the user.

In one aspect, the present garage door fixture allows for storage of fishing equipment in an area safe from being damaged, while being conveniently accessible by the user. The fishing rods stored at home either take up large areas of wall space or are bundled where they can be damaged or tangled by other items already stored in the area. Garage and home storage space is extremely limited for items of this nature and utilizing the garage door as a point for storage is unique and safe for utilizing with the design of the present invention. The designed clamping portion of the invention allows for simple and easy installation utilizing the ridges in the panels that holds the fixture of the present invention in place securely. It can be adjusted to any portion of the garage door panel to allow storage of similar elongated items of various lengths. For example, such elongated items may be skate boards, surf boards, garden tools, or the like.

While there are fishing rod holders that are installed directly to the wall or are free standing, each of these options takes up valuable space in a residence. The present invention is novel and advantageous over the prior art as its embodiments are designed for placement on movable surfaces that are not usable as storage space, such as the garage door panels. The design takes into consideration the movement of the garage door as it is raised and lowered, as well as the door braces along the panels that are used for strengthening the door during high winds such as hurricanes and tornadoes.

The open design of the invention allows fishing rods or other elongated equipment to be placed into the storage openings, and they stay in place during dynamic rotation of the garage doors. The fishing rods can be stored with reels, line, and equipment attached and can be easily removed from the storage holder. Other elongated equipment and associated parts can be similarly stored by using a fixture of the present invention.

As this invention utilizes the garage door panels for its attaching point without causing structural deformation of the panel or overloading the motor of the garage door opener, its unique placement and design has never been utilized to perform storage in this area.

Groups of People and/or Businesses that would Use the Invention

Due to the unique and innovative design of the product and intended use, the focus of the present invention is to households who indulge in outdoor sporting venues who own a garage door. From the 2011 National Survey of Fishing and Wildlife, 37.4 million people in the United States partake in fishing with a strong majority owning dwellings with a garage door.

Benefits to Users of Invention

A fixture of the present invention attaches to garage door panels utilizing a clamp design that requires no tools for installation. Placing fishing poles in the openings of the invention allow for ease of storage, ease of removal, protection from storing in a bundled area, frees much needed storage space within the home and allows the fishing poles or like items to be placed without need for removing attaching rod hardware. Since the garage door is utilized for the storage area, this allows for the extra space that can be used for other items requiring storage.

In an embodiment, the invention comprises fixtures for storage of elongated equipment, such as fishing rods or like items, in a unique way, the fixtures being attachable on or to a movable surface, such as the panels of a garage door. The fixtures are designed to not interfere with normal movement of the surface to which they are attached. The design will not obstruct with the garage door panel wind brace supports that are inherent in wind fortified garage doors. The attaching mechanism securely attaches directly to the panel with no tools or can be installed with or without self-tapping metal screws for metal surfaces or wood screws for wooden surfaces, such as metal or wooden garage doors. The invention can be utilized on each garage door panel and can be placed at any dimension from each other as deemed necessary by the user.

Figure 1B:
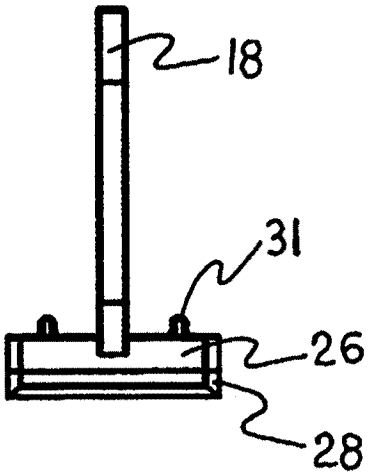
Figure 1C:
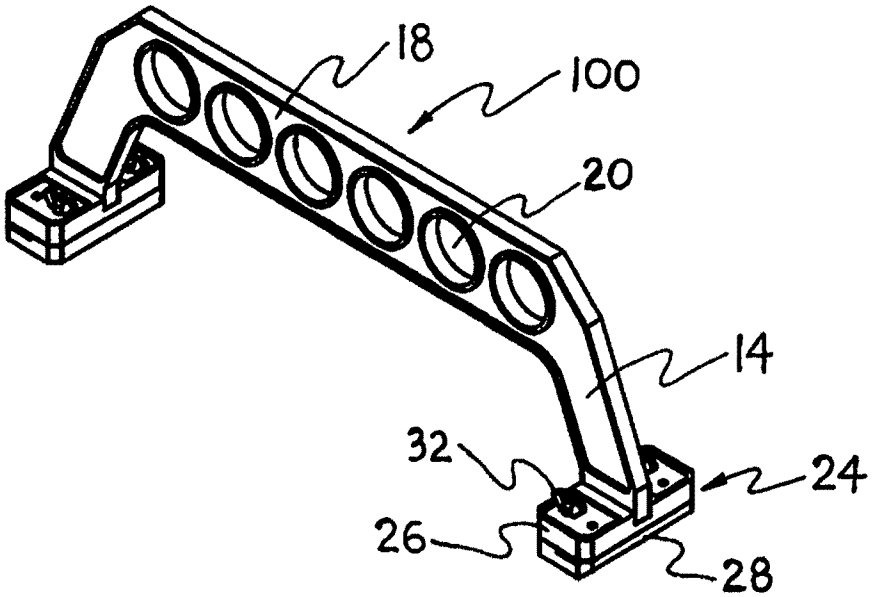
Figure 2A:
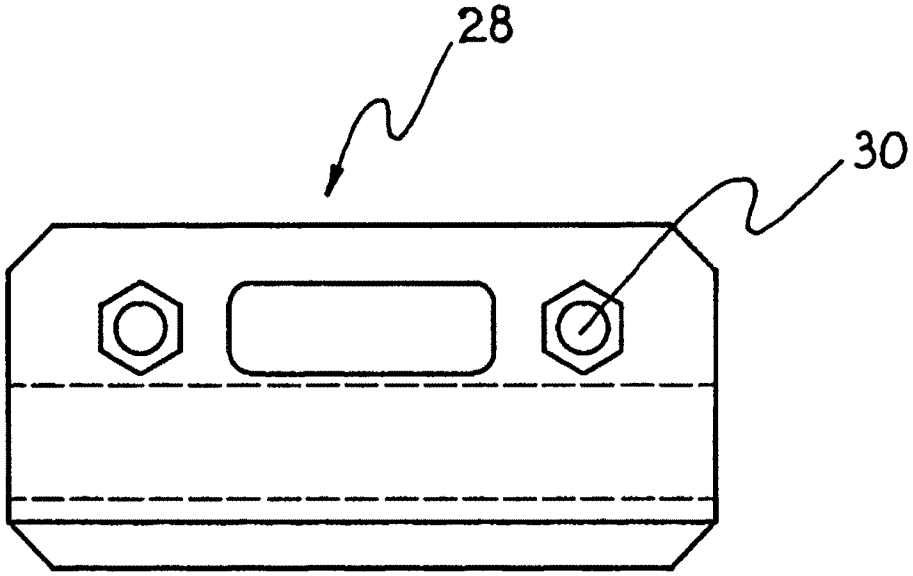
FIGS. 2A, 2B, 2C, and 2D show details of the clamping block in various views.
Figure 2B:
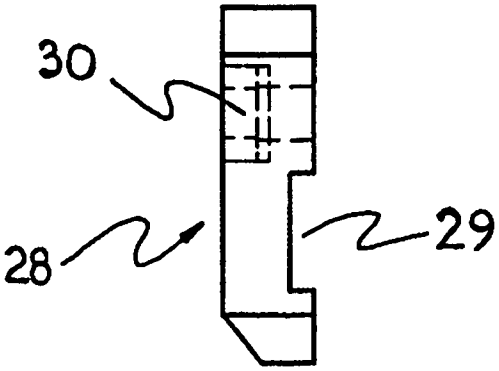
Figure 2C:
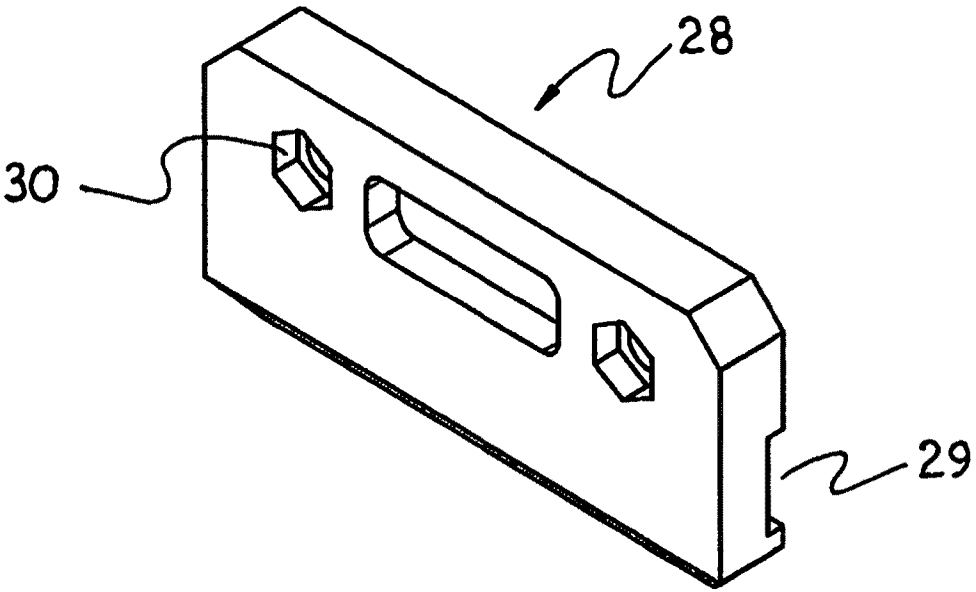
Figure 2D:
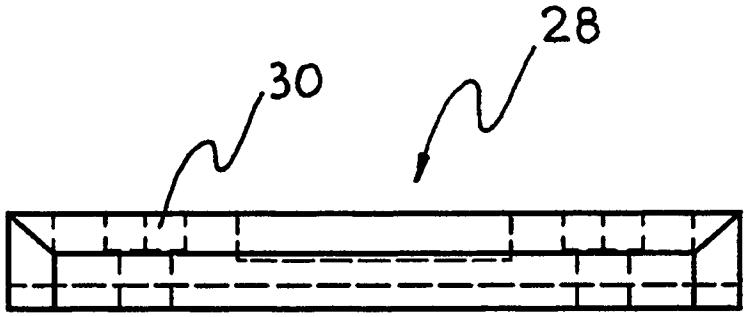
Figure 3A:
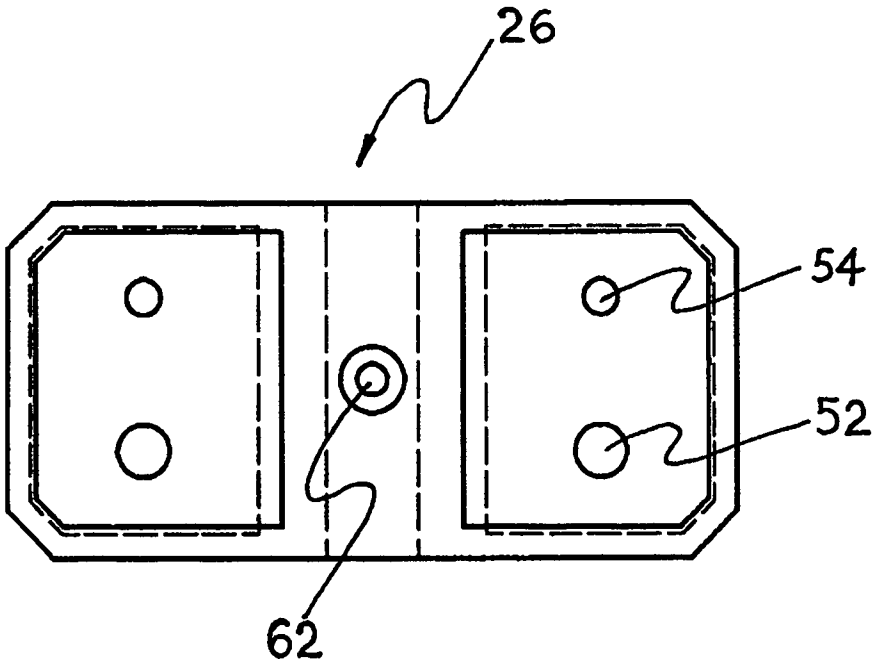
FIGS. 3A, 3B, 3C, and 3D show details of the leg-securing member in various views.
Figure 3B:
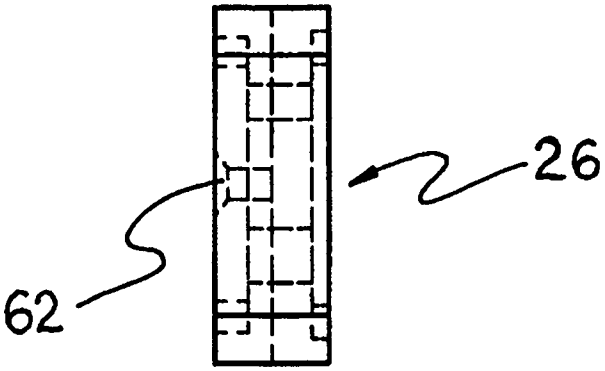
Figure 3C:
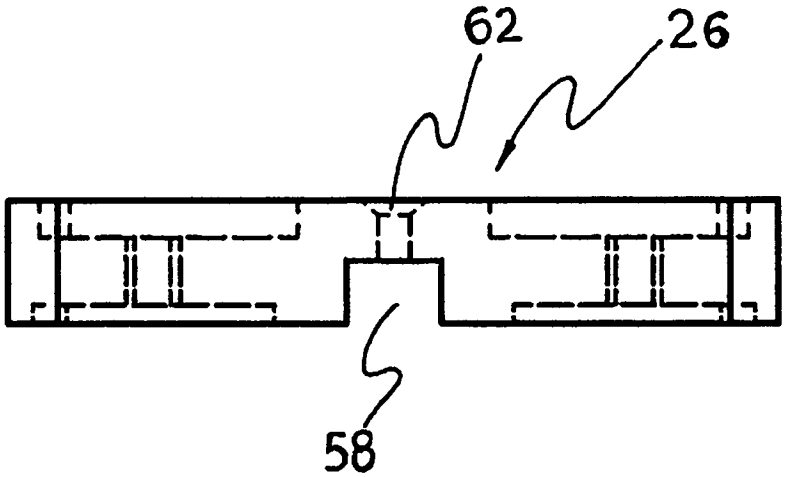
Figure 3D:
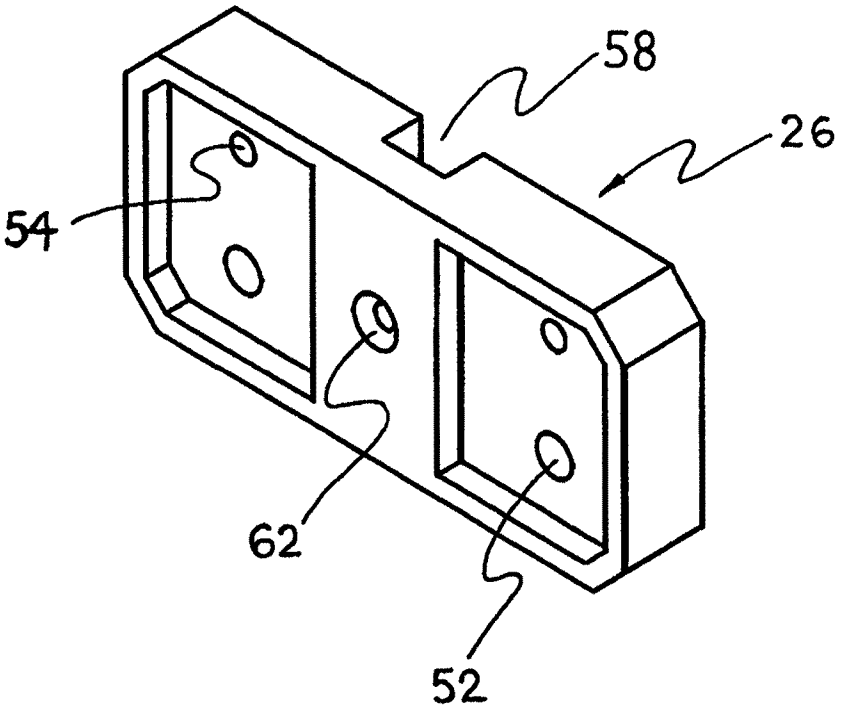

FIG. 1 shows one embodiment of the present invention. Fixture 100 adapted for attachment to a movable surface (not shown) for retaining or storing objects. Fixture 100 comprises a set of two fixture members 10. Each fixture member 10 comprises: (a) at least a leg portion 14 for attaching to the movable surface; and (b) a body portion 18 that includes at least an opening 20 therethrough, adapted for receiving one end of an elongated object (not shown); wherein the surface is movable from a first position that is within reach of a user to a second position that is out of reach of, but is accessible by, the user.

In the embodiment shown in FIG. 1, fixture member 10 comprises two leg portions 14, each extending from each end of body portion 18 at an angle. Each leg portion 14 comprises at least an attachment member 24, adapted for receiving fasteners for attaching fixture member 10 to the movable surface. Attachment member 24 is generally in a plane that is perpendicular to the plane of body portion 18, and extends from leg portion 14 at an angle.

Body portion 18 is where the fishing rods or like items are placed for retaining or storage while attached to the movable surface, such as a garage door. Typically, body portion 18 is about 17.5-18 inches long. Two fixtures 100 are required per garage door panel. Attachment member 24 has a dimension of about 2 inches×about 4 inches and braces to the outside of the garage door panel lip. Each opening 20 may be circular and has a diameter of about 2 inches that receives the fishing rods or like items for retaining or storage. In this embodiment, leg portion 14 is angled inwardly toward body portion 18 to prevent contact with the upper and/or lower garage door panels as the garage door is being raised or lowered. Thus, in this embodiment, the length of body portion 18 is less than the distance between the ends of leg portions 14. The distance between the outer edges of leg portions is selected such that the fixture member can be attached to the garage door panel lips and is typically 20.5-21 inches, 17.5-18 inches or 23.5-24 inches. A space of approximately 3-3.5 inches from the lower edge of body portion 18 to the bottom base 34 of attachment member 24 allows clearance with the garage door wind supports if they are installed. Additional spacers can be added if larger clearances are needed to clear larger wind supports if they are installed. Each attachment member 24 comprises a leg-securing member 26 and a clamp block 28. Typically, leg-securing member 26 has a dimension of about 2 inches×4 inches. Each leg-securing member also has at least two holes having diameter of about 0.15-0.2 inch that additionally allows the user to attach fixture 100 permanently to the movable surface with attaching hardware, such as self-tapping screws.

Clamping block 28, in cooperation with leg-securing member 26, attaches to fixture 10 to secure to the garage door panel. Clamping block 28 is placed behind the lip of the garage door panel and the attaching hardware secure fixture 100 in place. Clamping block 28 has groove 29 on the inward side to prevent binding and point loading on the folded portion of the garage door panel (see FIG. 2). Each clamping block 28 has two 0.44-inch hexagonal recess 30 for placement hexagonal head screw 31 so tools will not be required to restrain the head of the screw 31 when tightened with a wing nut 32. In one aspect, the overall dimension of clamping block 28 is substantially the same as that pf leg-securing member 26.

Hexagonal head screw 31, wing nut 32 and flat washer comprise the attaching hardware for fixture member 10 and clamping block 28.

Fixture member 10 and clamping block 28 are connected together by the attaching hardware (hexagonal head screw 31, wing nut 32 and flat washer) with the lip of the garage door end panel disposed between leg-securing member 26 and clamping block 28.

In another aspect, two fixtures 100 of the present invention may be connected together by a connecting member (not shown) to align the fixtures securely on the movable surface or to provide additional stability.

Description of How the Invention Attaches/Operates/Functions

The user will determine where fixtures 100 will be positioned on the garage door panel. For attaching the first fixture 100, two clamping blocks 28 and four hexagonal screws 31 are placed behind a raised feature on a garage door panel, such as the lip of the garage door panel, such that groove 29 on clamping block 28 is positioned over the lip of the garage door panel and the hexagonal head of screws 31 are securely inside hexagonal recesses 30 of clamping block 28. Fixture member 10 will then be placed on the outside of the garage door panel with hexagonal screws 31 through the 0.312-inch diameter holes of the leg-securing member 26. One (1) washer and one (1) wing nut 32 will then go over hexagonal screws 31 (4 places) and wing nuts 32 will be tightened hand tight to secure clamping block 28. The procedure above will then be repeated for the second fixture. The tightening of wing nuts 32 provides a secure clamping force on fixture 100 that prevents it from moving while in use.

The fishing rods, garden tools, or like items are then placed inside openings 20 of the first fixture 100 by inserting the small end of the fishing rod, garden tool, or like item through fixture 100 until enough clearance is achieved to place the other end back through the corresponding opening 20 of the other fixture 100. In using fixture 100 to store a fishing rod, the eyelets of the fishing rod prevent the rods from slipping out of the openings during garage door movement. Fixture 100 can be positioned closer or farther away from each other for optimum configurability by loosening the wing nuts 32 and sliding the whole fixture 100 along the garage door panel ridge.

If the user wishes to attach fixture 10 permanently to the garage door panel then a self-tapping metal screw can be used for metal garage door panels or wood screws for wood panels in the 0.15-0.2-inch diameter holes provided in leg-securing member 26 (2 places for each leg-securing member 26) but is not required.

Working prototypes of the present invention have been made using wood material and by carving or shaping such material. Plastic inject molding can be employed for manufacturing fixtures 100 that will withstand high and low temperatures.

Unique Features of Invention.

The attachment and design of fixture 100 to the garage door panel is both innovative and unique with utilizing an existing unused flat space of the garage area and the garage door for storage capabilities. With the clamping block design such that it can be placed behind the lip ends of the garage door panel and securing to fixture member 10, and groove 29 on the inward side of clamping block 28 to prevent binding and point loading on the folded portion of the garage door panel is uniquely advantageous. No tools will be required to restrain the head of screws 31 when tightened with wing nut 32.

The design of the inward-angled leg portions 14 prevents contact with the upper and/or lower garage door panels as the garage door is being raised or lowered. The approximate 3-3.5 in. space from the lower edge of body portion 18 to the bottom base attachment member 24 allows clearance with the garage door wind supports if they are installed.

As this invention utilizes the garage door panels for its attaching point without causing structural deformation of the panel or overloading the motor of the garage door opener, its unique placement and design has never been utilized to perform storage in this area.

ALTERNATIVE EMBODIMENTS OF INVENTION

With the unique features of the invention it can be adaptable for other light-weight storage capabilities with no changes. It can hold light-weight garden tools, similar sporting equipment that can be inserted into the openings that can also be adapted for holding or storing other products.

FIG. 3 shows details of leg-securing member 26. Leg-securing member 26 includes a pair of holes 52 through which bolts 31 are inserted to secure leg portion 14 to clamping block 28. A pair of holes 54 is provided for additional securing of fixture 100 to a movable surface by, for example, self-tapping screws. Leg-securing member groove 58 receives leg portion 14, which is secured to leg-securing member 26 by a fastener (such as a screw) inserted through hole 62 which extends through the thickness of leg-securing member 26 from side opposite to groove 58.

Figure 4A:
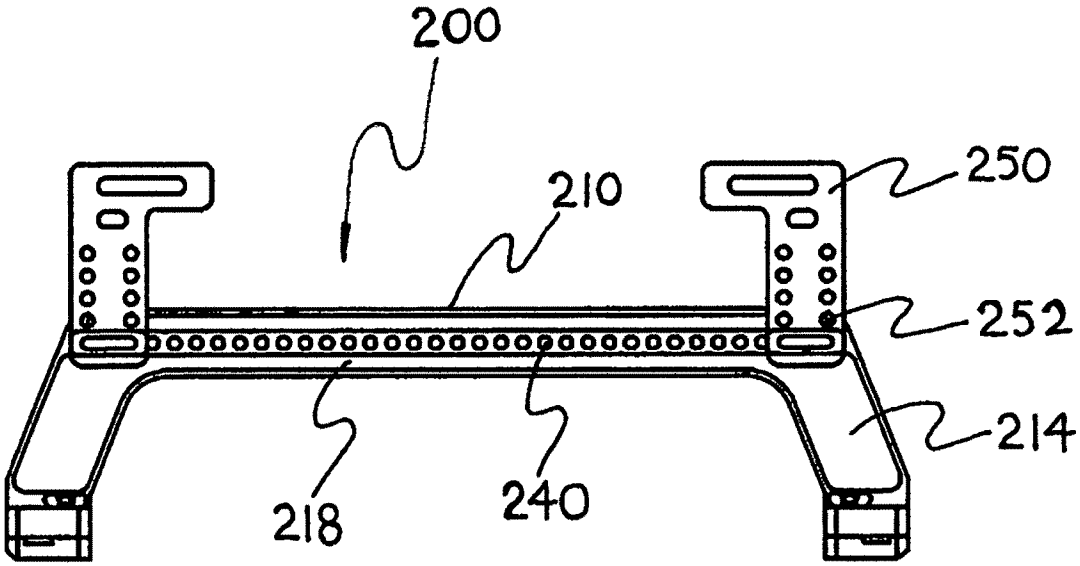
FIGS. 4A, 4B, and 4C show respectively the front view, side view, and isometric view of a second embodiment of the fixture of the present invention.
Figure 4B:
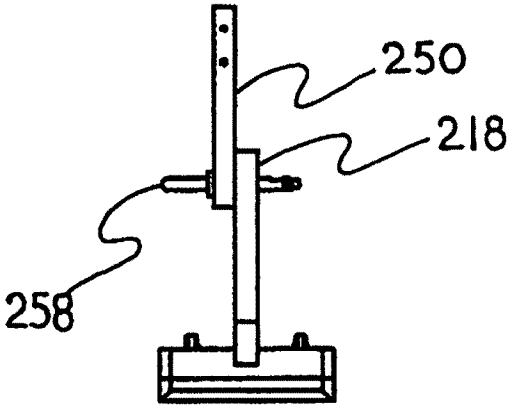
Figure 4C:
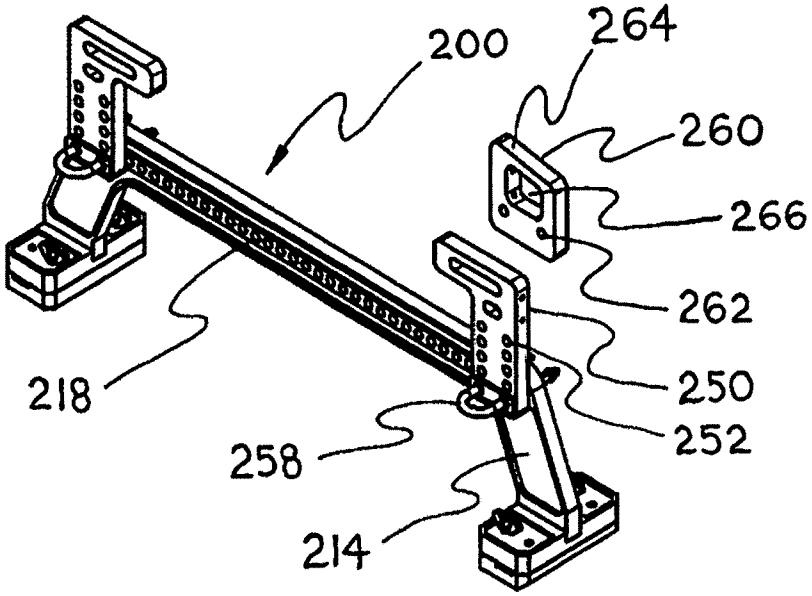
Figure 5:
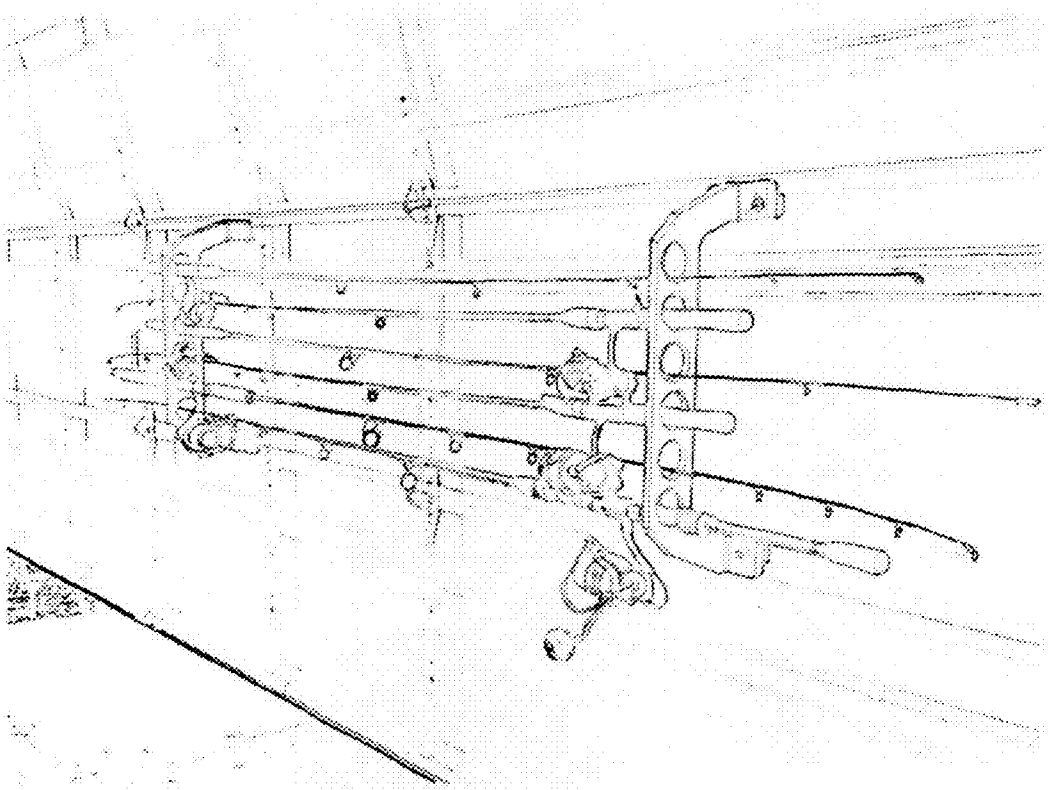
FIG. 5 shows an angled view of prototype of the invention in place on the garage door when the garage door is partially closed with a typical fishing rod arrangement.
Figure 6:
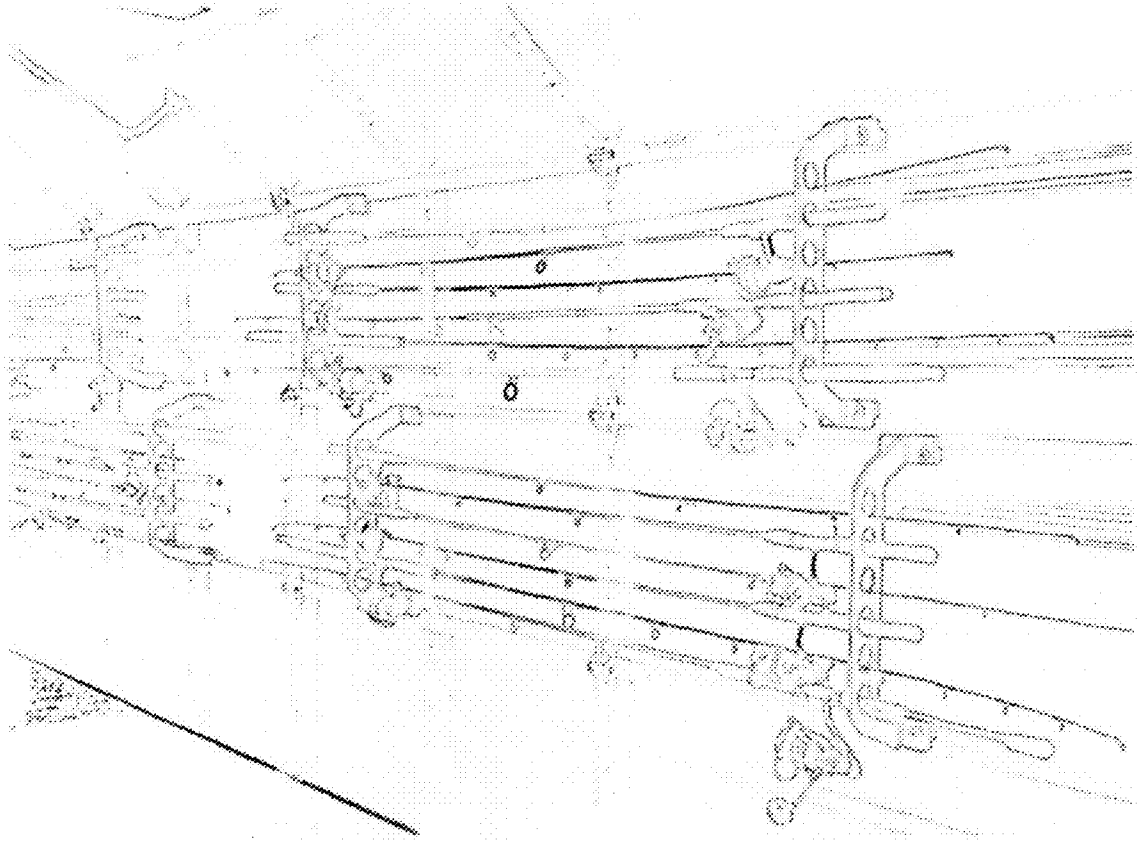
FIG. 6 shows a front angled view of typical storage arrangement of fishing rods placed in the invention when the garage door is closed.
Figure 7:
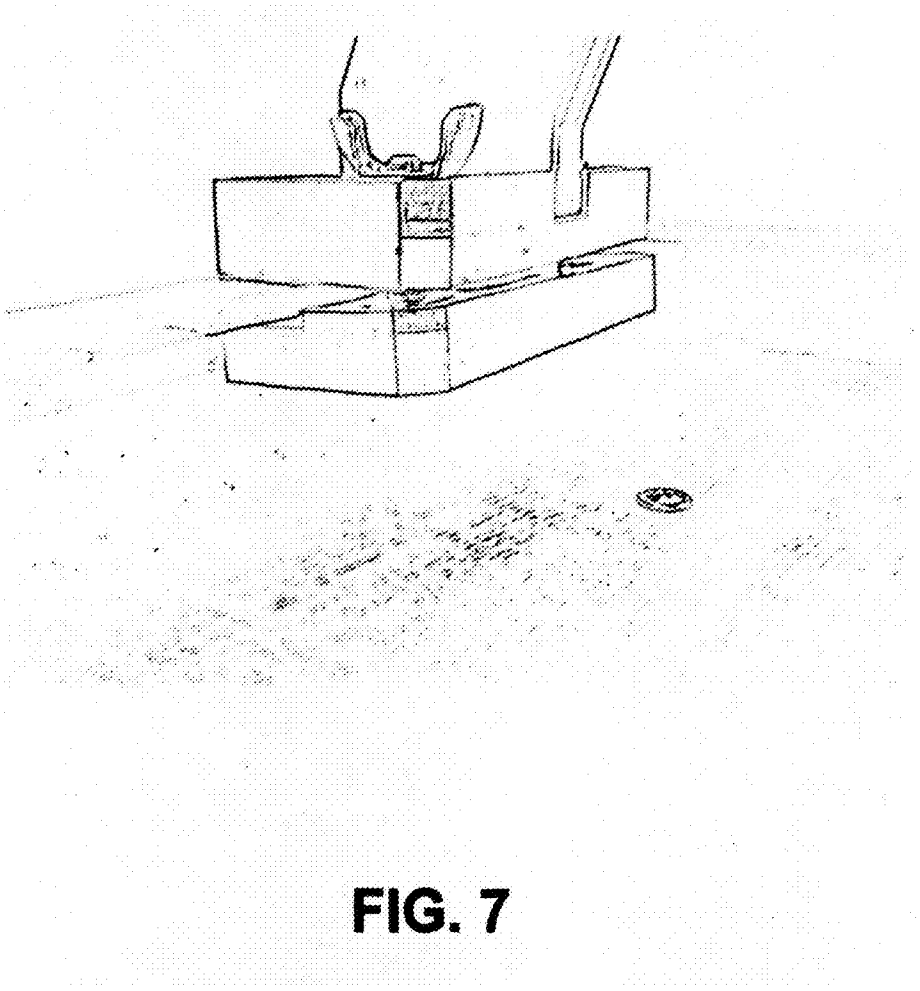
FIG. 7 shows a side angled view of the prototype of the invention leg-securing member and clamping block attached to the garage door panel.
Figure 8:
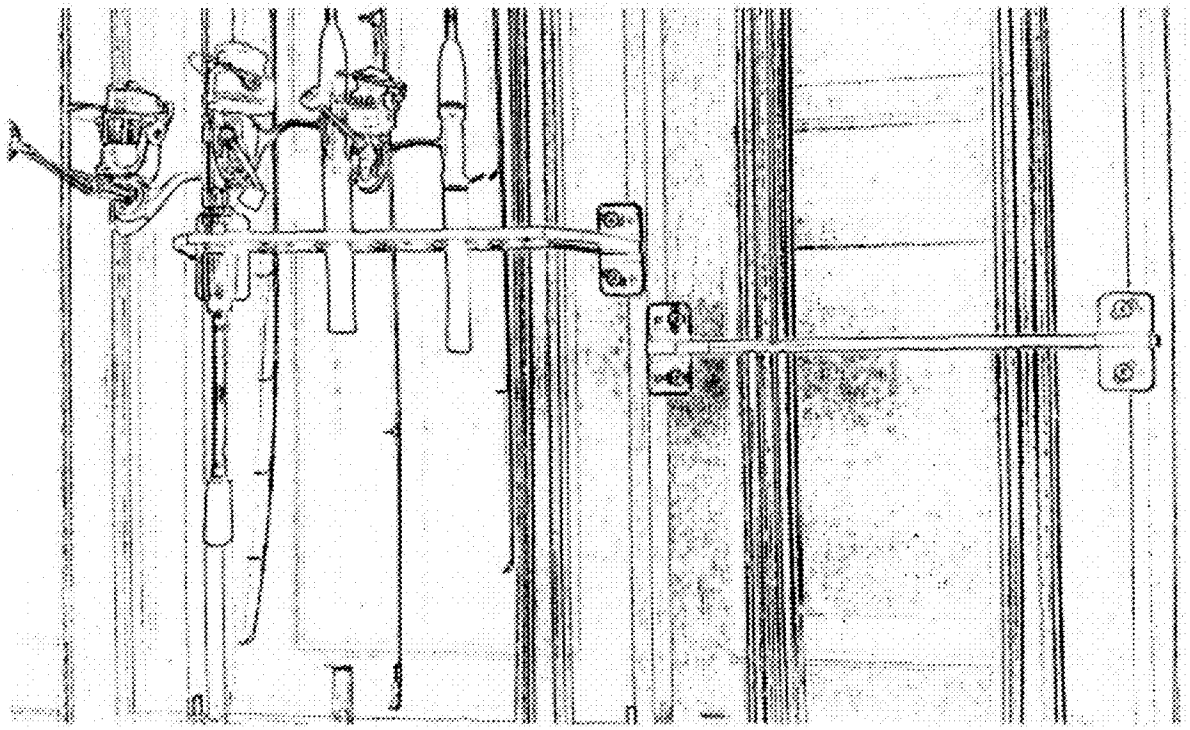
FIG. 8 shows a front view of a fixture of the prototype of the invention in place on the garage door when the garage door is partially closed with a typical fishing rod arrangement.
Figure 9:
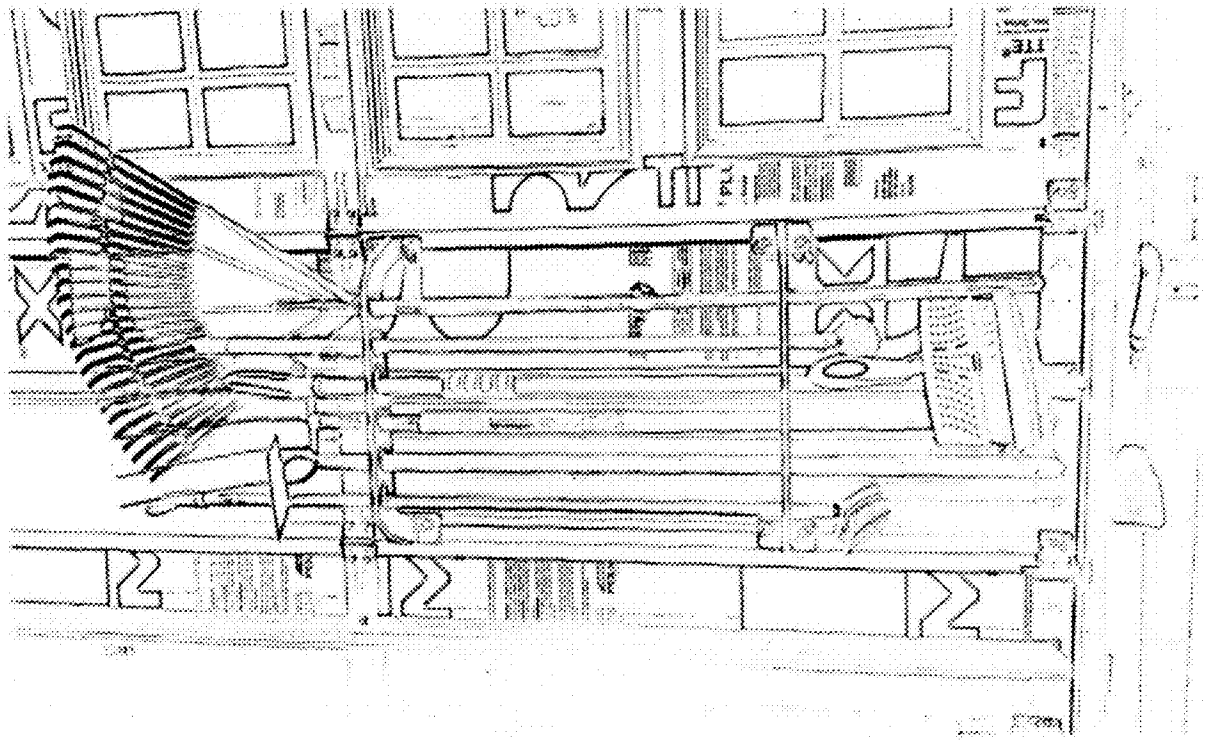
FIG. 9 shows a front view of a fixture of the present invention used to retain and store garden tools.
Figure 10:
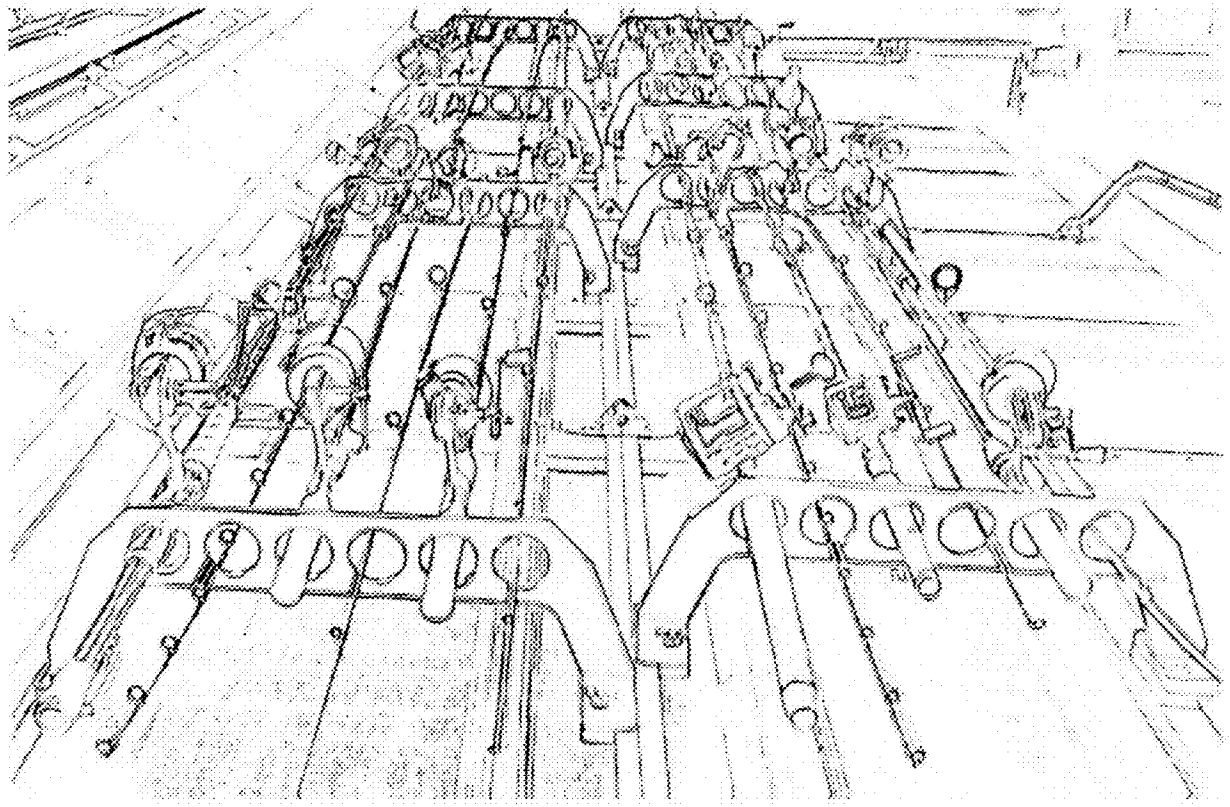
FIG. 10 shows an angled view of a fixture of the present invention used to retain and store fishing rods with the garage door opened.
Figure 11:
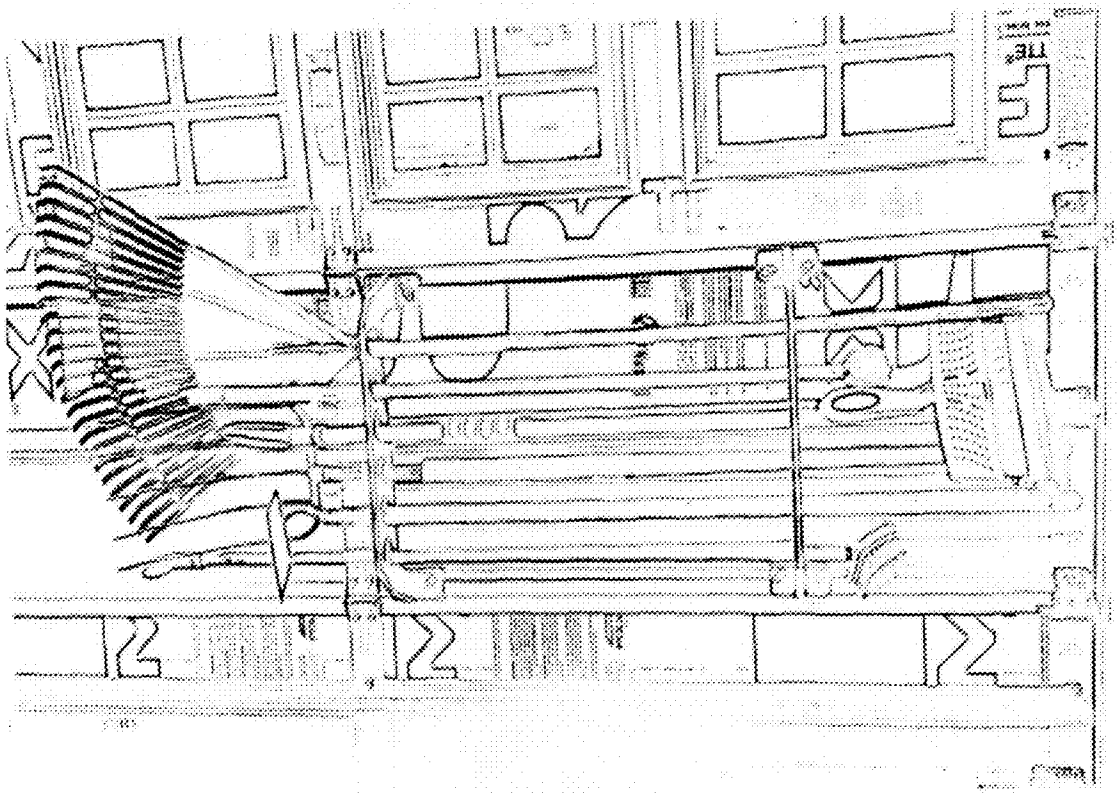
FIG. 11 shows an angled view of a fixture of the present invention used to retain and store garden tools with the garage door closed.
Figure 12:
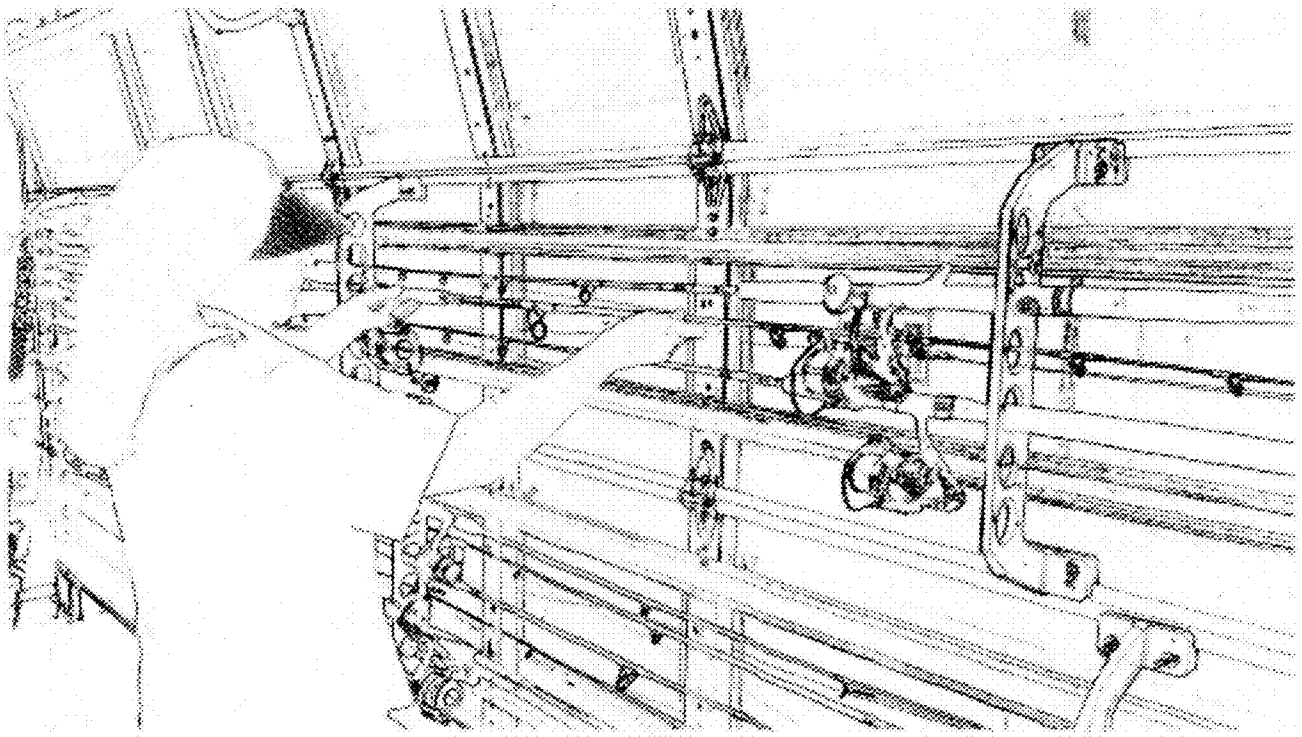
FIG. 12 shows objects being placed in the openings of a fixture of the present invention.

FIG. 4 shows an alternative embodiment that is adapted for retaining or storing other shaped object. Fixture 220 comprises a fixture member 210 that comprises body portion 218 and leg portion 214. Body portion 218 includes a plurality of holes or openings 240 that extend through its thickness. One or more extension members 250 provides the capability to adapt fixture member 210 for retaining or storing objects of different shapes, such as non-circular shapes. Extension member 250 comprises at least one matching hole or opening 252 that matches with at least one hole or opening in body portion 218 for securing extension member 250 to body portion 218 by, for example, a fastener such as a bolt. In one embodiment, extension member 250 comprises two rows of matching holes or openings 252. The distance between the two rows of matching holes or openings 252 matches with the distance between two adjacent holes or openings 240 in body portion 218 such that extension member 250 may be secured to body portion 218 at two places. For example, extension member 250 may be secured to body portion 218 by a U-shaped bolt 258 that is inserted through a pair of adjacent holes or openings 240 in body portion 218 and matching holes or openings 252. Extension member 250 comprises a non-circular shaped opening 254 for retaining or storing non-circular shaped objects. For example, opening 254 is shown in FIG. 3 as a narrow and wide opening that is suitable for retaining or storing flat and wide objects, such as skis.

Extension member 260 in FIG. 4 is another embodiment of extension member that can be used with fixture 200. Extension member 260 includes a pair of matching holes or openings 262 for securing it to body portion 218, in a similar manner disclosed above. Extension member includes opening 266 that can serves to receive and retain one end of an object to be retained and stored. Extension member 260 has a free inclined edge 264 on which an object, such as a surf board, to be retained and stored may rest and secured to fixture 200 by, for example, a strap (not shown). With the provision of an extension member, a fixture of the present invention may be adapted for retaining or storing a wide variety of different shaped objects.

Identification of Elements/Parts/Components of Embodiments of the Present Invention

| Reference Numeral | Name of Part |
|---|---|
| 10 | Fixture member |
| 14 | Leg portion |
| 18 | Body member |
| 20 | Openings |
| 24 | Attachment member |
| 26 | Leg-securing member |
| 28 | Clamping block |
| 29 | Groove in clamping block |
| 30 | Hexagonal recess |
| 31 | Hexagonal screw |
| 32 | Wing nut |
| 34 | Bottom base of attachment member |
| 52 | Holes for receiving hexagonal screws |
| 54 | Holes for receiving additional screws for securing fixture 100 to a movable surface |
| 58 | Groove in leg-securing member for securing leg portion 14 |
| 62 | Hole for receiving screw for attaching leg portion 14 to leg-securing member 26 |
| 100 | Fixture |
| 200 | Fixture |
| 210 | Fixture member |
| 214 | Leg portion |
| 218 | Body portion |
| 240 | Holes or openings |
| 250 | Extension member |
| 252 | Matching holes or openings |
| 254 | Non-circular opening |
| 258 | U-shaped bolt |
| 260 | Extension member |
| 262 | Matching holes or openings |
| 264 | Inclined edge |
| 266 | Non-circular shaped opening |

While specific embodiments of the present invention have been described in the foregoing, it will be appreciated by those skilled in the art that many equivalents, modifications, substitutions, and variations may be made thereto without departing from the spirit and scope of the invention as defined in the appended claims.

What is claimed is:

1. A fixture adapted for attachment to a movable surface, the fixture comprising a set of two fixture members, each member comprising: (a) only two leg portions for attaching to the movable surface; (b) a substantially planar one piece body portion adapted to include a plurality of openings extending therethrough, at least one opening adapted for receiving one end of an elongated a fishing rod, skis, or a garden tool; and (c) an attachment member attached to each leg portion for attaching the fixture member to the movable surface; the attachment member extending perpendicular to the body portion wherein the movable surface is a panel of a garage door; wherein each leg portion extends from one end of the body portion; each leg portion is angled inwardly toward the body portion forming an angle greater than 90 degrees and less than 180 degrees and resulting in a length of the body portion being less than a distance between the two leg portions; and wherein the fixture provides a clearance space of about 3 to 3.5 inches or more between a lower edge of the body portion and a bottom of the attachment member.

2. The fixture of claim 1, wherein the attachment member is adapted to receive a fastener for attaching the fixture to the movable surface; and the attachment member comprises: (i) a leg-securing member for attaching the leg portion to the leg-securing member; and (ii) a clamping block; wherein the attachment member extends from the leg portion at an angle.

3. The fixture of claim 2; wherein the attachment member is in a plane that is substantially perpendicular to the plane of the body portion.

4. The fixture of claim 2; wherein the attaching of the fixture to the panel of the garage door is effected by securing a feature of the panel of the garage door between the leg-securing member and the clamping block.

5. The fixture of claim 1; wherein the two fixture members are connected together by a connecting member.

6. The fixture of claim 1; wherein the fixture member is attachable to a raised feature of the panel of the garage door.

7. A fixture adapted for attachment to a movable interior surface of a panel of a garage door, the fixture comprising a set of two fixture members, each member comprising: (a) only two leg portions for attaching to the movable surface; (b) a substantially planar one piece body portion adapted to include a plurality of openings extending therethrough, at least one opening adapted for receiving one end of an elongated a fishing rod, skis, or a garden tool; and (c) an attachment member attached to each leg portion and adapted to receive a fastener for attaching the fixture member to the movable surface; wherein the attachment member comprises: (i) a leg-securing member for attaching the leg portion to the leg-securing member; and (ii) a clamping block; wherein the attachment member extends from the leg portion at a perpendicular angle; wherein each leg portion extends from one end of the body portion; each leg portion is angled inwardly toward the body portion forming an angle with the body portion, said angle being greater than 90 degrees and less than 180 degrees; and resulting in a length of the body portion being less than a distance between the two leg portions; and wherein the fixture provides a clearance space of about 3 to 3.5 inches or more between a lower edge of the body portion and a bottom of the attachment member.

8. The fixture of claim 7; wherein the attachment member is in a plane that is substantially perpendicular to the plane of the body portion.

9. The fixture of claim 7; wherein the two fixture members are connected together by a connecting member.

10. The fixture of claim 7; wherein the fixtures are attached to said interior surface of said garage door.

11. The fixture of claim 7; wherein the attachment member is in a plane that is substantially perpendicular to the plane of the leg portion; and the attachment member is adapted for receiving fasteners for attaching the fixture to the garage door.

12. The fixture of claim 1; wherein each leg portion extends from the body portion at an angle greater than 90 degrees and less than 180 degrees.

* * * * *